US005457836A

United States Patent [19]

Wiedeck

[11] Patent Number: 5,457,836

[45] Date of Patent: Oct. 17, 1995

[54] DEPLOYABLE BRIDGE AND APPARATUS FOR LAYING THE SAME

[75] Inventor: Hans-Norbert Wiedeck, Mülheim, Germany

[73] Assignee: Krupp Fördertechnik GmbH, Duisburg, Germany

[21] Appl. No.: 200,620

[22] Filed: Feb. 23, 1994

[30] Foreign Application Priority Data

Feb. 25, 1993 [DE] Germany ..... 43 05 764.0

[51] Int. Cl.[6] ..... E01D 15/12

[52] U.S. Cl. ..... 14/2.4; 14/14

[58] Field of Search ..... 14/2.4, 2.5, 4, 14/5, 14

[56] References Cited

U.S. PATENT DOCUMENTS 5,063,630 11/1991 Wiedeck ..... 14/2.4

FOREIGN PATENT DOCUMENTS

0374019A1 12/1989 European Pat. Off. .
0391148A2 3/1990 European Pat. Off. .
0407235A1 5/1990 European Pat. Off. .

*Primary Examiner*—Ramon S. Britts
*Assistant Examiner*—James A. Lisehora
*Attorney, Agent, or Firm*—Spencer, Frank & Schneider

[57] ABSTRACT

The invention relates to a bridge comprising at least one bridge elements. The bridge elements has a base body that has chamfered end surfaces on which roadway plates rest that can be necessarily brought out of a drive-on position into a coupling position by hinged ramp plates in that respectively two bridge elements are moved toward the ramp plates into a drive-on position. The apparatus for laying the bridge has a guide (support rail, holding sheet) for the guide members of the ramp plates so that the bridge elements can be reliably guided together. Moreover, the apparatus has guide rails with which the locking elements (hook, pins) can be centrally actuated.

11 Claims, 7 Drawing Sheets

FIG. 1
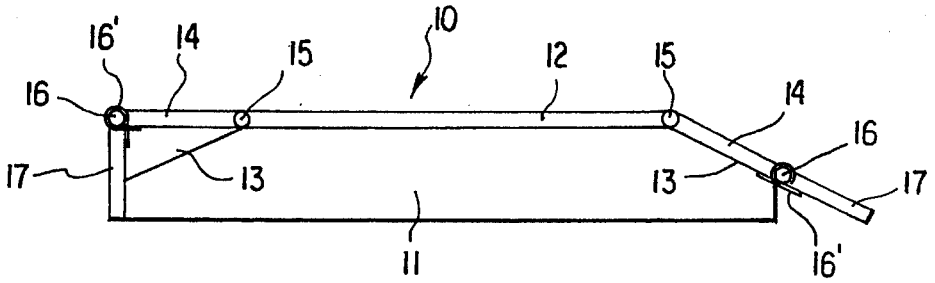
FIG. 3
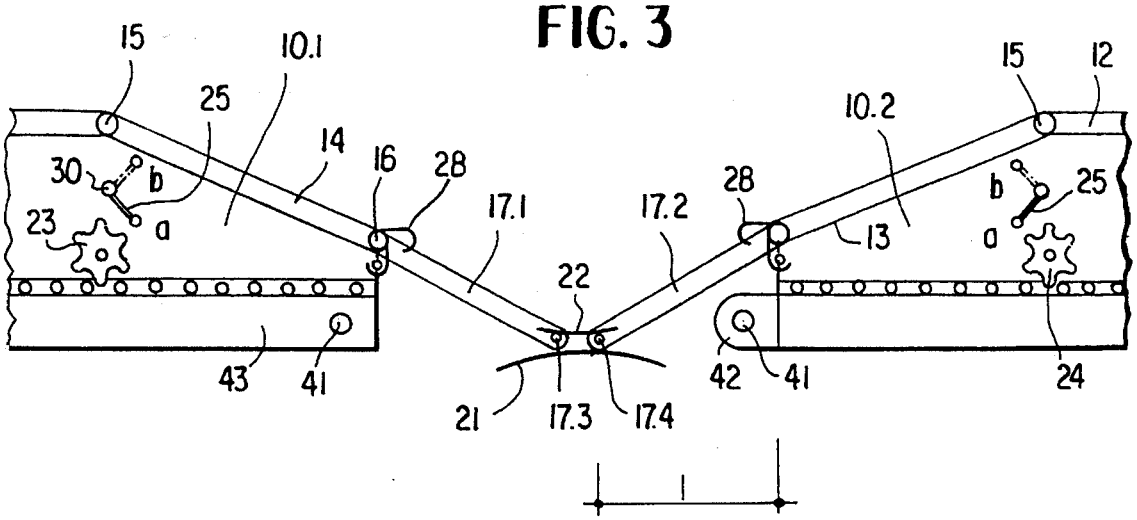
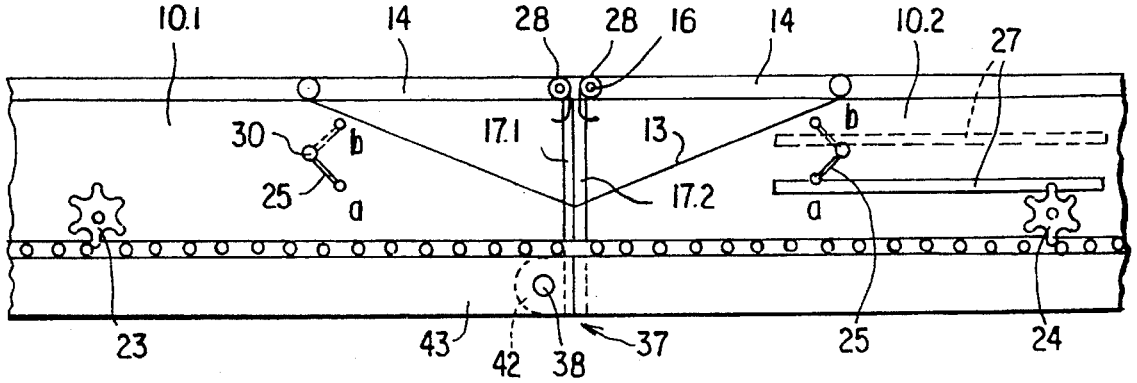
FIG. 4

10.2
10.1
19
18

10.1
10.2

10.2
10.1

10.1
10.2

10.1
10.2

10.1
10.2

10.1
10.2

10.1
18.1
10.2

DEPLOYABLE BRIDGE AND APPARATUS FOR LAYING THE SAME

BACKGROUND OF THE INVENTION

The invention relates to a bridge having at least one bridge element that has a bridge base body with chamfered end surfaces and roadway plates that are pivotable around a shaft disposed in the region of the upper edge of the chamfered end surfaces, wherein ramp plates are hinged at the end of the roadway plates opposite the pivot shaft, and the roadway plates either lie on the chamfered end surfaces to form a drive-on ramp, and the ramp plates rest on the top of the embankment, or the roadway plates are pivoted away from the end surfaces to connect two contiguous bridge elements to form a bridge, and the ramp plates are pivoted into an essentially vertical position and the roadway plates that face one another and are parts of the bridge elements to be coupled can be locked directly with one another, and wherein lower chord locking means are provided, with which the lower chords of the bridge elements to be coupled can be locked. The invention further relates to an apparatus for laying a bridge.

Deployable bridges used particularly as prospect bridges are configured such that they are pushed across the river or ravine and laid with the aid of a vehicle provided with a bridge-laying apparatus. For this purpose the bridges are either configured in one piece or of the fewest possible pieces, in dimensions that permit transport on a land vehicle. Multiple-part bridges must meet the requirement that the individual sections can not only be joined with simple handling, but also must be structurally designed for relatively heavy vehicle loads. A generic bridge and a bridge-laying vehicle suited for laying it are known from EP-OS 0,391,149.A2.

For bridges of this type whose length must be variable, a bridge element or section is provided that has at least one joint whose horizontal axis extends perpendicular to the longitudinal direction of the bridge, around which joint a roadway section located in the end region of the section can pivot. The roadway and roadway section can be configured in one piece or as two parallel tracks. The hinged roadway sections can either be pivoted upwardly and rotated in such a way that their ends can be coupled and locked to a further bridge element, together with the end of the base body, or the roadway sections lie downwardly-pivoted on the base body and form a drive-on ramp. In EP-OS 0,391,149.A2, linear motors, particularly hydraulic cylinders, are proposed as adjustment apparatuses for pivoting the roadway sections.

SUMMARY OF THE INVENTION

It is an object of the invention to further develop a bridge of the type mentioned at the outset and a bridge-laying device in such a way that the handling during bridge laying can be improved by means of a bridge-laying apparatus, without sacrificing flexibility in adaptation to existing obstacle widths.

This object is attained in accordance with the invention in that the roadway plates can be locked or released by means of a coupling hook, that the coupling hook can be actuated by a pulling mechanism of a rotatable coupling shaft, and that the lower chord locking means are connected to the roadway plate locking means via a common actuating arrangement.

By means of the common actuating arrangement for locking the pivotable roadway plates or sections and the lower chords, these can be locked or released together and simultaneously—and thus in a simple, time-saving manner—for connecting to a further bridge element, or for two bridge elements to be separated. The common actuation or release of the two locking means can be executed in a simple manner from the bridge-laying apparatus. The described construction is additionally mechanically sturdy and insusceptible to interference.

The joint is preferably prestressed between the roadway plate and the ramp plate by means of a spring; a torsion spring has proven particularly effective. It is thereby accomplished that, even in the ramp position of the roadway plate, the prestress in the torsion spring is still great enough that the ramp plate does not come to rest with its point beneath the level of the lower bridge edge.

In accordance with a further embodiment of the invention, the locking of bottom chords is preferably provided as a pin coupling with pins that are displaceably guided transversely to the bridge elements, the pins extending into bores of tabs or cheeks of the bottom chord of the bridge elements in the locked position. The use of the pin coupling permits a simple, reliable coupling of the bottom chords, because the connection is capable of taking up forces occurring in the longitudinal direction of the bridge, as well as transverse forces perpendicular thereto. For example, the pins can be supported on both sides of the tabs so that a favorable load situation results for them.

In accordance with the invention, a coupling shaft serves as the common actuating arrangement, on which shaft a control disk is mounted that has guide grooves, into which a carrier member extends that is connected to a pulling element for roadway plate locking, and with which disk a further control disk for the pins, likewise having guide grooves, is connected via a bar linkage. To optimize the guide groove or guide grooves, the guide groove or grooves have an involute shape.

To be able to pull the pins into their locked position automatically, the pins have members that are guided in a control groove actuated by the further control disk.

In accordance with a further embodiment of the invention, the crankshaft can be actuated by a coupling lever. The bottom chord locking means are acted upon by a spring in the direction of locking.

Moreover, the ramp plates can preferably be fixed in the vertical position and secured against lateral displacement, and roadway plates that lie against one another and are part of contiguous bridge elements are supported by the relevant ramp plates hinged there.

In an apparatus in accordance with the invention for laying a bridge, support rails are provided on which the free ends of the ramp plates of two bridge elements can be guided during their movement toward one another, which significantly simplifies guiding the bridge element together. When the bridge elements are guided together, the ramp plates right themselves without being further handled or additionally engaged, and transfer the pivotable roadway sections into their top coupling position.

In accordance with a further embodiment, a holding sheet is additionally disposed above the support rail, by means of which sheet a guide is formed with the support rail, into which lateral guide members of the ramp plate extend.

In accordance with a further embodiment of the invention, a coupling rail is used in the bridge-laying apparatus that is adjustable in height, that is, adjustable in the vertical direction, and by means of which the coupling lever of the crankshaft of the bridge can be actuated. The two control disks can thus be actuated synchronously by the movement of the coupling rail.

BRIEF DESCRIPTION OF THE DRAWINGS

An embodiment of the invention is illustrated in the drawing figures. Shown are in:

FIG. 1 a side view of a bridge element having a bridge base body and two movable roadway plates and two ramp plates, FIGS. 2*a* to 2*n* bridge-laying vehicle provided with two bridge elements in FIG. 1, in different phases of bridge element coupling and laying, FIG. 3 a detailed side view of two bridge element ends in a preparatory position for coupling, FIG. 4 the same bridge element ends of FIG. 3 in the coupled state, FIG. 5 a fragmentary side view of a bridge element, FIG. 6 a fragmentary cross-section along line VI—VI in FIG. 5, FIG. 7 the bridge element in a cross-section along line VII—VII in FIG. 5, and FIGS. 8*a* to 8*p* the laying of two bridge elements as individual bridges.

DETAILED DESCRIPTION OF THE INVENTION

Figure 2A:
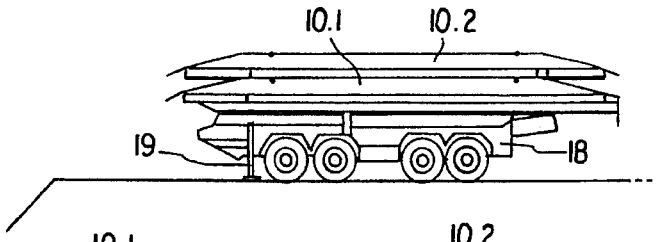
Figure 2B:
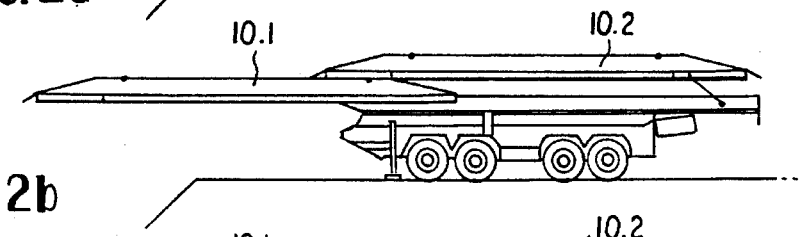

The bridge section or bridge element 10 as part of the bridge of the invention comprises a bridge support or bridge base body 11, which includes an upper cover or roof element as a roadway 12 and two chamfered end surfaces 13 at the ends, on which a roadway plate 14 can rest or be supported to form a drive-on position (right side of FIG. 1). The roadway plate is connected to the bridge element 10 via a pivot shaft 15 disposed in the region of the upper edge of the chamfered end surface 13. At the opposite end, the roadway plate has a further joint 16 for a ramp plate 17 disposed on the end side. The roadway plate 14 can, as shown in the left half of the drawing, be pivoted upwardly to the same height as the roadway 12, so that when the ramp plate 17 is pivoted downwardly and thus located in the vertical position, a connecting end is created for a further bridge element.

Figure 2C:
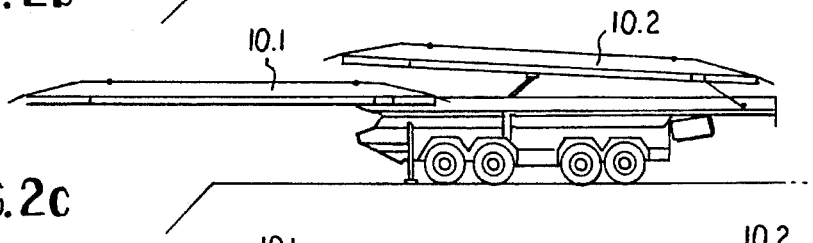
Figure 2D:
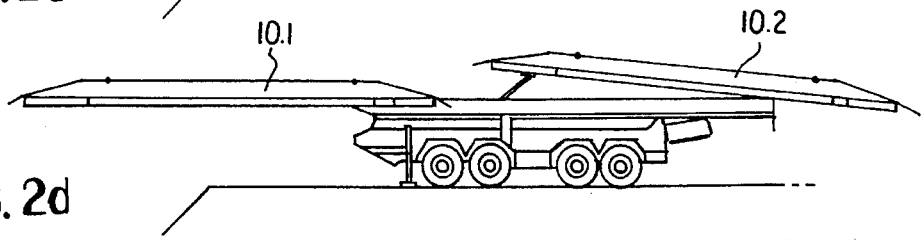
Figure 2E:
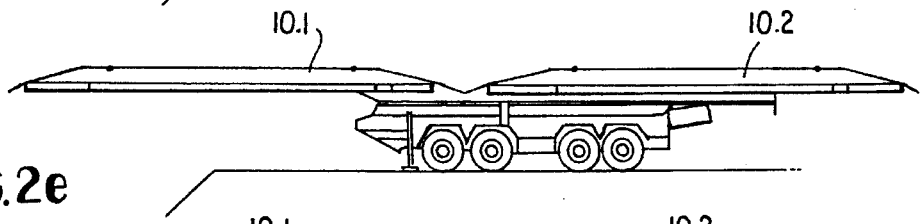
Figure 2F:
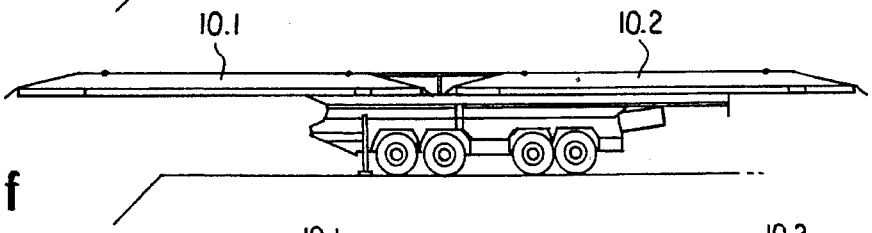
Figure 2G:
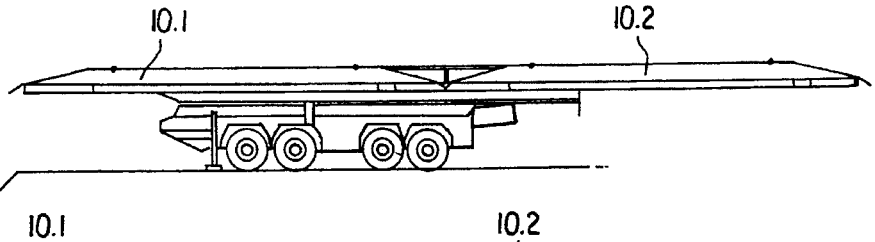
Figure 2H:
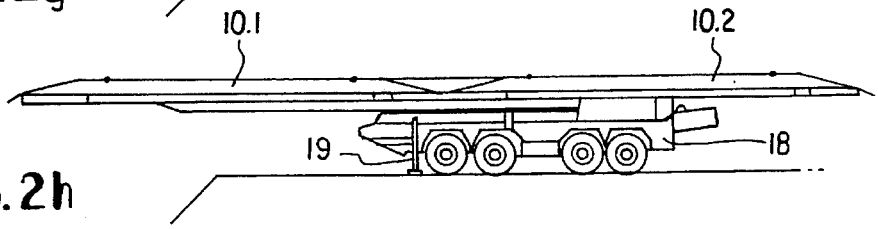
Figures 2I, 2J, 2K, 2L, 2M, 2N:
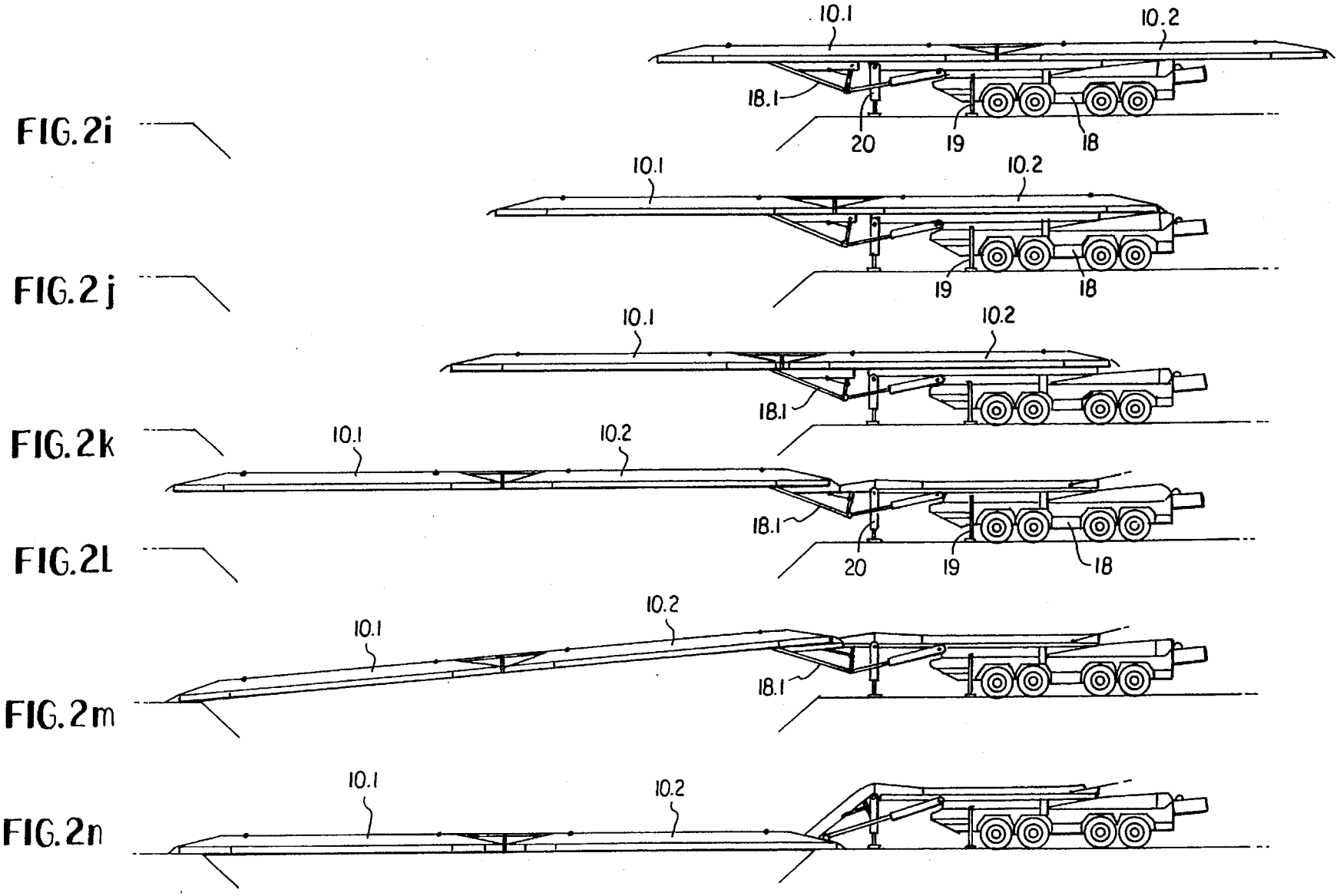

Referring also to FIGS. 2*a*–2*n* , to transport, for example, two bridge elements 10.1 and 10.2, a transport vehicle 18 is used that has a bridge-laying apparatus 18.1 and is extensively known from the prior art. In the transported state, the end-side roadway plates 14 are pivoted downwardly, that is, they lie on the chamfered end surfaces 13. The frame stand of the vehicle 18 also includes extendable floor support elements 19, which are first extended. Nest, the bridge element 10.1 seated below is moved forward by means of a forward bridge drive in order to create space for the upper bridge element 10.2 for positioning on the bridge-laying apparatus 18.1. The upper bridge element 10.2 is subsequently lowered toward the back (FIG. 2*c*) and then moved to the right in the Figure until the end located above the vehicle 18 is in the region of the opposite end of the bridge element 10.1. In the region of the vehicle, the bridge element 10.2 is then lowered to the level of the bridge element 10.1 (FIG. 2*e*). By means of the bridge drive, the two bridge elements 10.1 and 10.2 are moved toward one another and, as shown in FIG. 2*f*, coupled to one another, which will be referred to later. Subsequently the unit formed from the two bridge elements 10.1 and 10.2 is extended to the front, for which further support elements 20 on the displacement frame of the vehicle 18 are used (FIG. 2*i*). The different phases of bridge placement are to be taken from FIGS. 2*l* through 2*n;* the bridge-laying apparatus 18.1 is extensively known from the prior art.

FIG. 3 shows a detailed section corresponding to FIG. 2*e* or 2*f*, in which the ramp plates 17.1 and 17.2 of different bridge elements 10.1 and 10.2 are located opposite one another at their free ends. A support rail 21 disposed on the bridge-laying apparatus 18.1 and a holding sheet 22 disposed above it serve to support these ramp plates, thereby forming a guide into which lateral guide members 17.3, 17.4 extend that are secured to the ramp plates 17.1 and 17.2. The roadway plates 14 are necessarily lifted by means of bringing the bridge elements 10.1 and 10.2 together by means of drives 23 and 24 of the bridge-laying apparatus 18.1, because the foot point of the ramp plate 17.1 and 17.2, respectively, is held by the guide formed on the bridge-laying apparatus by support rail 21 and holding sheet 22, and deflection is thus prevented. During the entire coupling process, the coupling lever 25 remains in position "b" (open), which purpose a coupling rail 27 serves that is disposed on the bridge-laying apparatus 18.1 and is adjustable in the vertical direction (FIG. 4). The coupling rail must have a length of at least "l" that corresponds to the projected length of the ramp plate 17 or 17.1, 17.2, seen in a top view.

After the bridge elements 10.1, 10.2 have been moved together on the bridge-laying apparatus 18.1, the coupling lever 25 is brought into the locked position "a" shown in FIG. 4 by means of downward pivoting or lowering of the coupling rail 27.

Figure 5:
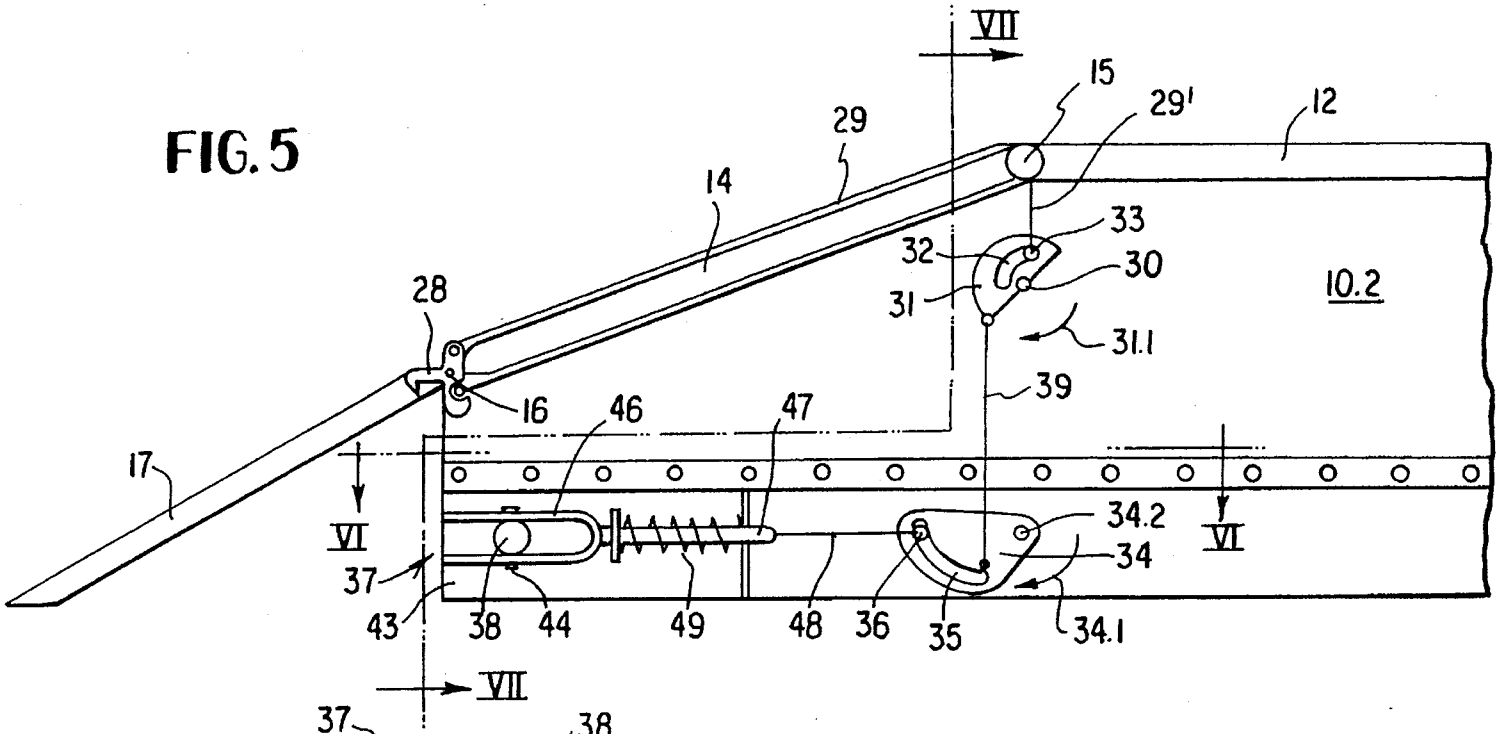

The roadway plates 14 are connected to one another by means of coupling hooks 28. Referring also to FIG. 5, these are connected to a pulling mechanism 29, which can be actuated by a crankshaft 30. On the crankshaft 30, an upper control disk 31 is locatable at two positions and has guide grooves 32 in involuted form, into which a carrier member 33 extends that is connected to the end of the pulling element 29' at the opposite end of the coupling hook 28. The control disk 31 is connected via a bar linkage 39 to a lower control disk 34, which likewise has a guide groove 35 in involuted form, in such a manner that the rotational movement of the upper control disk 31 is transferred onto the lower control disk 34 via the coupling bar linkage 39. The guide groove 35 serves to guide a carrier member 36, which is connected to the lower chord locking means 37 that have pins 38. The control disk 34 serves to actuate pins 38.

Figure 6:
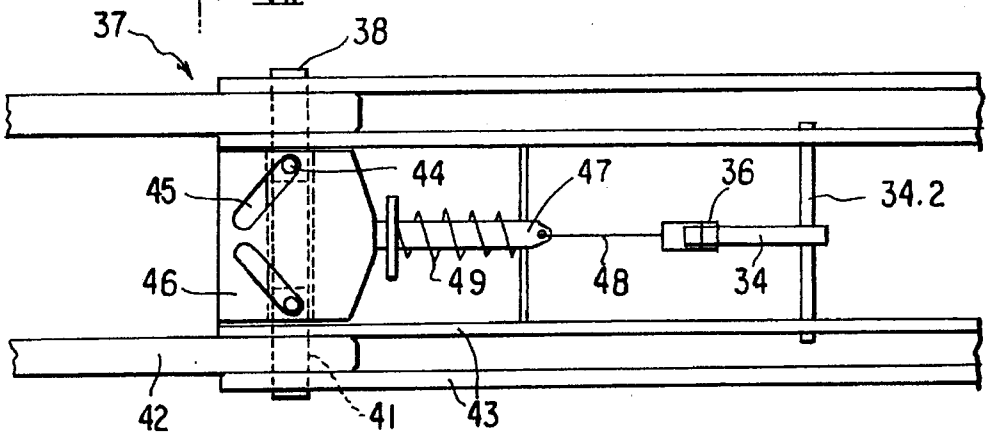

As shown in FIG. 6, the pins 38 are guided in bores 41 of tabs 42 of the lower chord of the bridge element 10.1 and the cheeks 43 of the lower chord of the bridge element 10.2, which cheeks receive the tabs 42. The pins 38 have members 44 above and below that engage, in V-shaped control grooves 45, a sliding guide 46 that encompasses the pins from above and below. At its end facing the control disk 34, the sliding guide 46 is provided with a holder 47 that is connected to the carrier member 36 via a pulling element 48. A prestressed spring 49 presses the sliding guide 46 into a position in which the pins 38 are pressed into the locking position via the bores 41 because of the necessary guidance.

Figure 7:
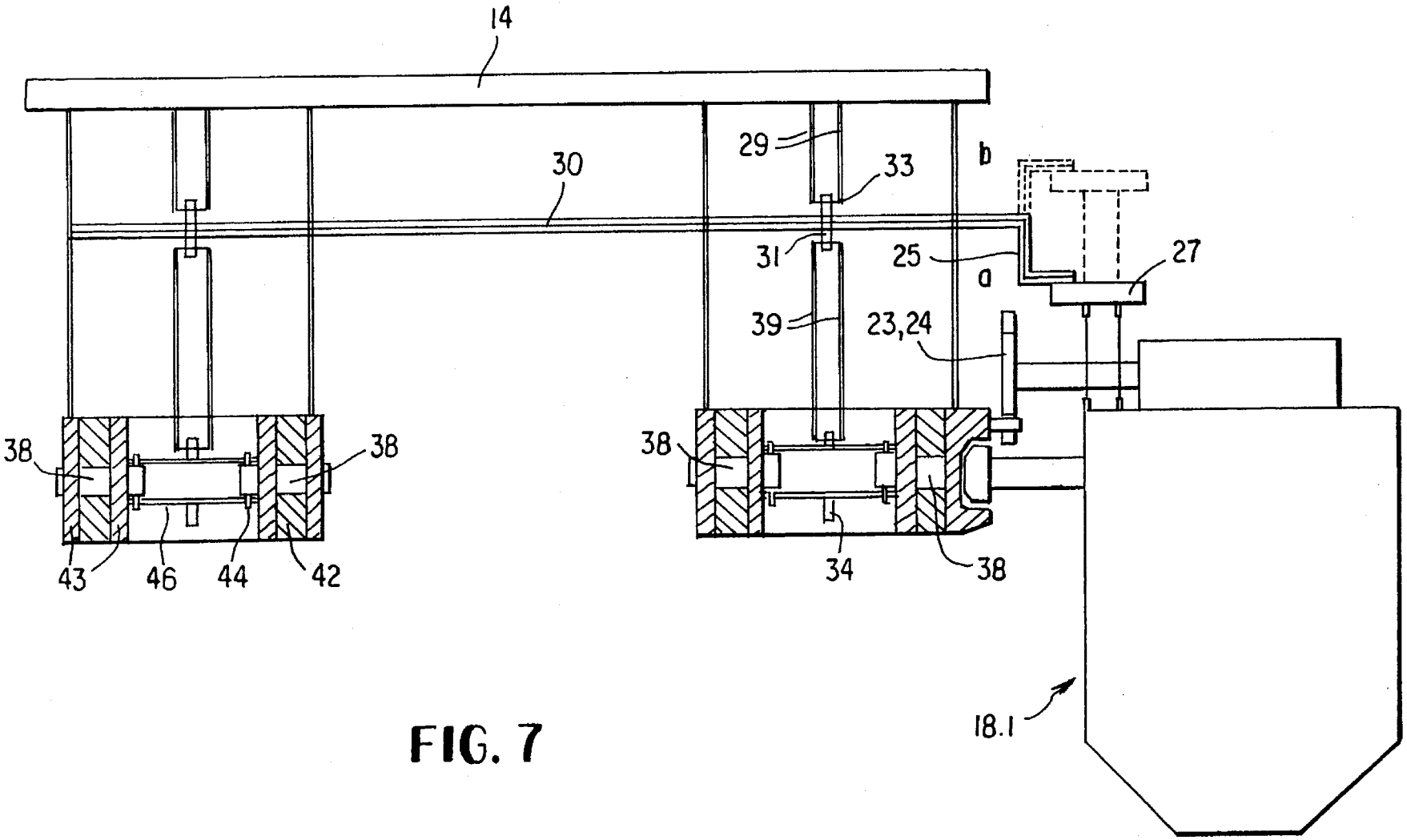

In the locking state of bridge elements 10.1, 10.2, the lever 25 is located in the lower position "a" (see FIGS. 4 and 7), and the control disks 31, 34 are in the position illustrated in FIG. 5. In this position, the carrier member 33 is at a greater distance from the pivot axis of the cam disk or control disk 31 and the crankshaft 30 because of the shape of the control curve or guide groove 32. The pulling mechanisms 29, and 29' are released and the coupling hook 28 can bring about a locking with the other bridge element at the roadway height (upwardly-pivoted roadway plate 14 or roof element 12).

The described locking creates a deflection-resistant transverse force connection between two bridge elements 10.1 and 10.2 with a normal force-shearing force connection by means of the pin connection in the lower chord, the normal force by means of the hook connection in the upper chord of the roadway plate, and a support of the roadway plates by the ramp plates.

The release of the bridge elements 10.1, 10.2 is effected in the following manner:

The control disk 31 is pivoted in the direction of arrow 31.1 by the lifting the coupling rail 27 from the bridge-laying apparatus 18.1, consequent actuation of the lever 25 and pivoting into its position "b," and corresponding rotation of the crankshaft 30. During this the carrier member 33 is pulled in the direction of the axis of rotation of the crankshaft 30 because of the shape of the control curve, that is, the guide groove 32, and along with it the pulling mechanisms 29, and 29' that in turn pulls the coupling hook 28 out of the locked position into the position that releases the bridge element 10.1.

The control disk 34 is pivoted around the axis of rotation 34.2 in the direction of arrow 34.1 via the coupling bar linkage 39 simultaneously with the pivoting of the control disk 31. During this the effective radius of the control curve or guide groove 35 is reduced, and the sliding guide 46 is pulled counter to the pressure stress of the spring 49 in the direction toward the axis of rotation 34.1. The members 44 of the pins 38 must necessarily move toward one another through the V-shaped control grooves 45, and the pins are correspondingly pulled out of the outer cheeks 43 of the bridge element 10.2 and the tab 42 of the bridge element 10.1: the bridge elements 10.1 and 10.2 are released from one another.

Figures 8A, 8B, 8C, 8D, 8E, 8F, 8G, 8H:
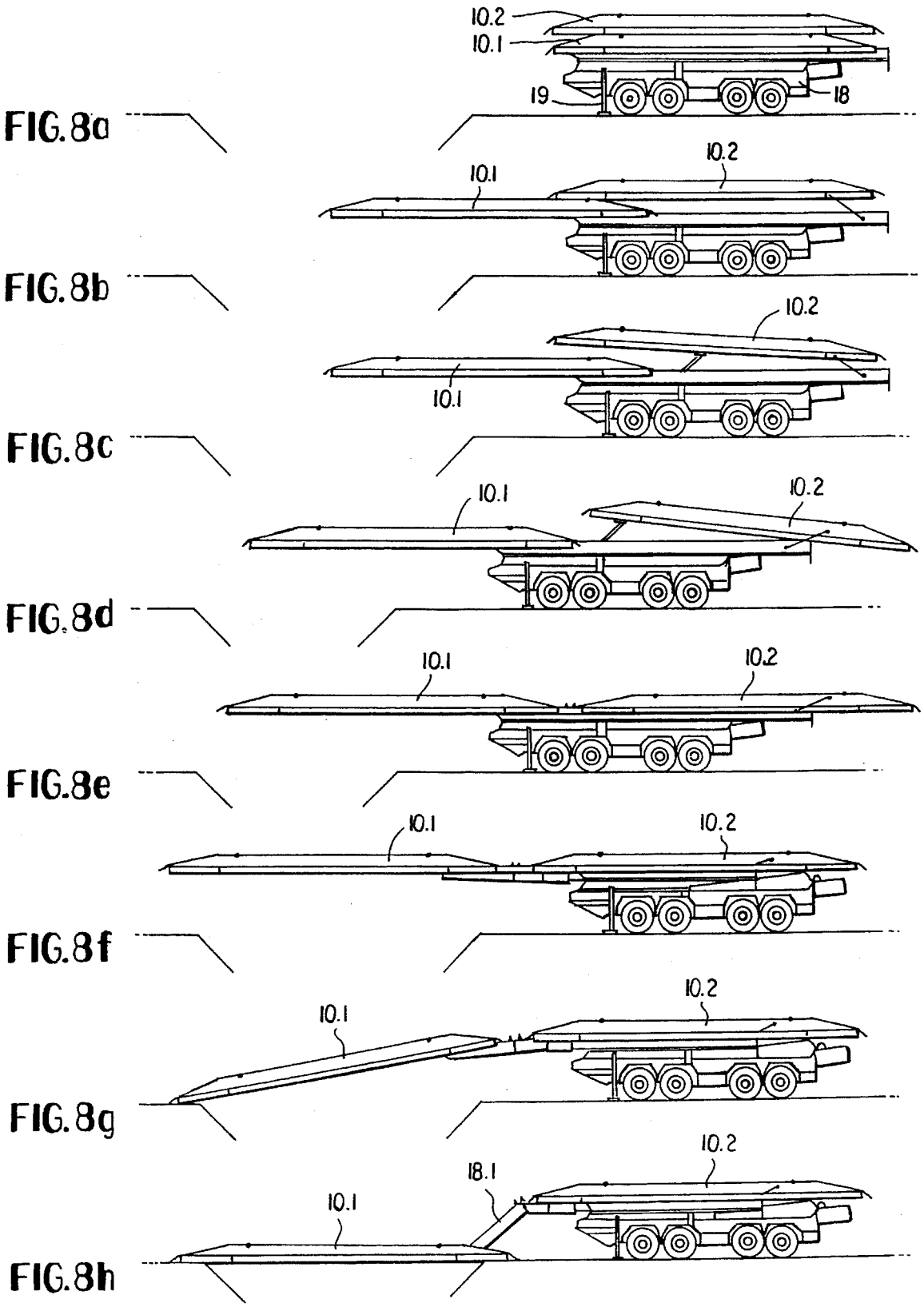
Figure 8I:
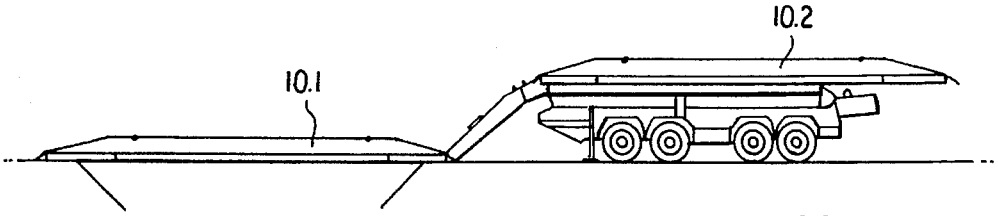
Figure 8J:
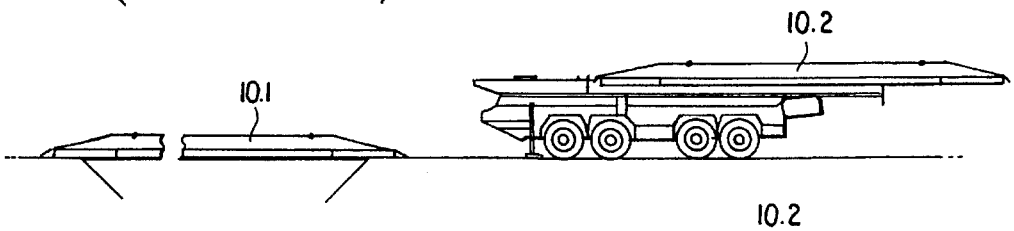
Figure 8K:
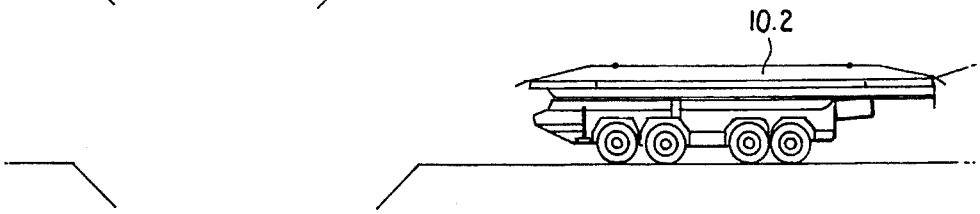
Figure 8L:
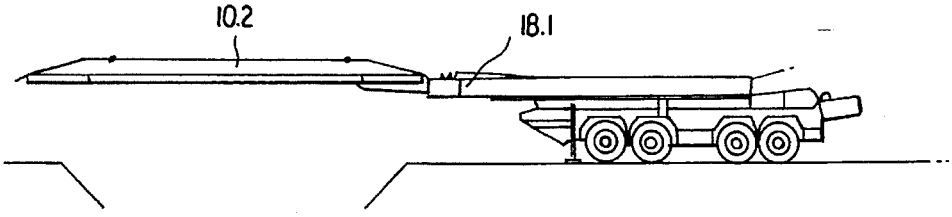
Figure 8M:
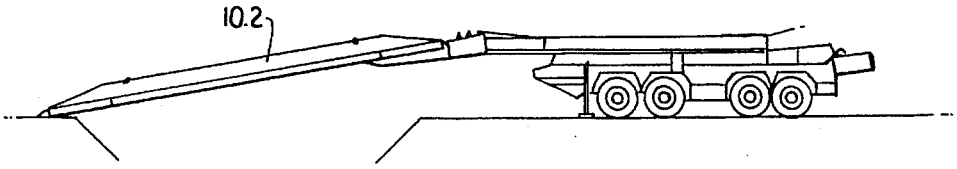
Figure 8N:
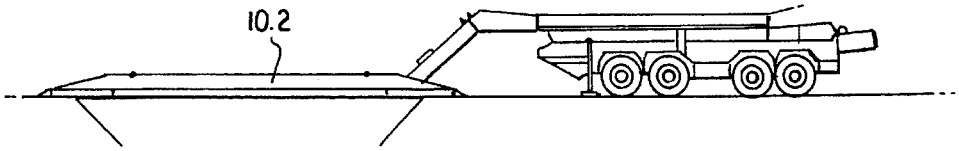
Figure 8O:
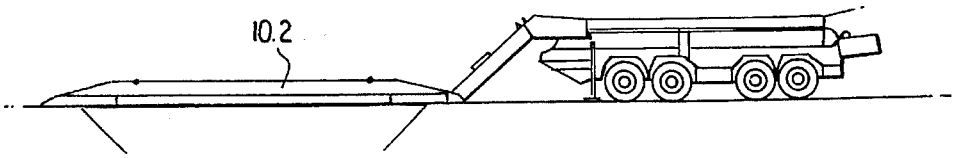
Figure 8P:
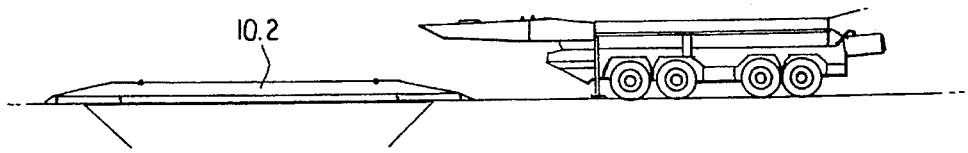

The bridge elements of the invention can also be used as individual bridges, however. For this purpose the bridge elements 10.1, 10.2 are driven on the transport vehicle 18 to the obstacle to be bridged. The forward pushing of the bridge element 10.1 and the lowering of the bridge element 10.2 are executed as described in FIGS. 2*a* through *d*. However, the bridge elements 10.1 and 10.2 are not subsequently coupled with one another, but laid individually, namely by means of the bridge-laying apparatus 18.1, which is known in principle from the prior art. After the bridge element 10.1 is laid (FIG. 8*h, i*), the vehicle 18 drives to the next position in which the remaining bridge element 10.2 (FIG. 8*e*) can be laid as a short bridge. This is demonstrated by FIGS. 8*l* through 8*p*.

The ramp plates 17 or 17.1, 17.2 are respectively prestressed upwardly by a torsion spring 16', counter to the roadway plate 14, in such a way that the ramp plates do not travel with their guide members 17.3 or 17.4 beneath the level of the lower bridge edge, and can therefore glide well on the support rails 21.

I claim:

1. A bridge comprising:

a plurality of contiguous bridge elements, each said bridge element including:

a bridge base body with a chamfered end surface, and an upper edge on said chamfered end surface;

a lower chord located opposite to the upper edge of said chamfered end surface;

a pivot shaft disposed proximate to said upper edge of the chamfered end surface;

a roadway plate pivotable at one end around said pivot shaft; and a ramp plate hinged to said roadway plate at a joint located at an end opposite to the one end; wherein the roadway plate of each said bridge element is pivotable to a first position so as to lie on the chamfered end surface to form a drive-on ramp with the ramp plate resting on top of an embankment, said roadway plate of each said bridge element also being pivotable away from said chamfered end surface to a second position to connect two of said plurality of contiguous bridge elements to form said bridge whereby the ramp plate of each said bridge element is in an essentially vertical position and the roadway plates abut one another; and locking means for locking said two bridge elements together when said roadway plates are in said second position, comprising:

lower chord locking means for coupling and releasably locking together the lower chords of the bridge elements;

a coupling hook releasably locking together the abutting roadway plates;

a pulling mechanism for actuating said coupling hook; and a common actuating arrangement connecting the lower chord locking means with the coupling hook, and including a rotatable coupling shaft connected to said pulling mechanism.

2. The bridge as defined in claim 1, wherein the joint is prestressed between the roadway plate and the ramp plate by means of a spring.

3. The bridge as defined in claim 2, wherein the spring is a torsion spring.

4. The bridge as defined in claim 1, wherein the lower chords have bores and the lower chord locking means are configured as a pin coupling having pins guided to be displaceable transversely to the bridge elements, wherein the pins extend into the bores to place said locking means in a locked position.

5. The bridge as defined in claim 4, wherein the common actuating arrangement includes a control disk having guide grooves mounted to said coupling shaft, into which grooves a carrier member extends that is connected to the pulling mechanism for locking the roadway plates, which disk is connected via a bar linkage to a further control disk for the pins that likewise has guide grooves.

6. The bridge as defined in claim 5, wherein the guide grooves exhibit an involuted shape.

7. The bridge as defined in claim 5, wherein the pins have members that are guided in a control groove actuated by the further control disk.

8. The bridge as defined in claim 1, wherein the coupling shaft is actuated by means of a coupling lever.

9. The bridge as defined in claim 1, wherein the lower chord locking means are acted upon in a direction of locking by a prestressed spring.

10. The bridge as defined in claim 1, wherein the ramp plates are fixed in the vertical position when in the second position, and are secured against lateral displacement.

11. The bridge as defined in claim 1, wherein when the roadway plates are in the second position, they are supported by the ramp plates.

* * * * *